United States Patent [19]

Kraiss

[11] Patent Number: 4,737,094

[45] Date of Patent: Apr. 12, 1988

[54] MOLDING DEVICE FOR SHAPING CONCRETE PARTS

[75] Inventor: Richard Kraiss, Laichingen-Suppingen, Fed. Rep. of Germany

[73] Assignee: Georg Prinzing GmbH & Co KG Betonformen - und Maschinenfabrik, Blaubeuren, Fed. Rep. of Germany

[21] Appl. No.: 856,773

[22] Filed: Apr. 24, 1986

[51] Int. Cl.[4] ..... B28B 21/16

[52] U.S. Cl. ..... 425/182; 249/102; 249/177; 425/432; 425/456

[58] Field of Search ..... 425/123, 182, 192 R, 425/432, 456, 427; 249/177, 102, 65; 264/312, 69, 71

[56] References Cited

U.S. PATENT DOCUMENTS 4,168,917 9/1979 Mukhin et al. ..... 366/124

FOREIGN PATENT DOCUMENTS 3049492 7/1982 Fed. Rep. of Germany ..... 425/432
3115181 11/1982 Fed. Rep. of Germany ..... 425/432
3328400 2/1985 Fed. Rep. of Germany ..... 425/432

*Primary Examiner*—Jay H. Woo
*Assistant Examiner*—James C. Housel
*Attorney, Agent, or Firm*—Michael J. Striker

[57] ABSTRACT

A molding device includes a mold core provided with a centering ring which is insertable on an inner centering ring attached to a core jarring machine. To clamp the centering rings one to the other, there is provided a hydraulic clamping device in the form of an elastic ring segment which is an integral part of one of the centering rings and adjoins a pressure chamber communicating with a source of hydraulic liquid. When pressure in the chamber is increased, the ring segment is elastically deformed and clamps the opposite ring.

4 Claims, 3 Drawing Sheets

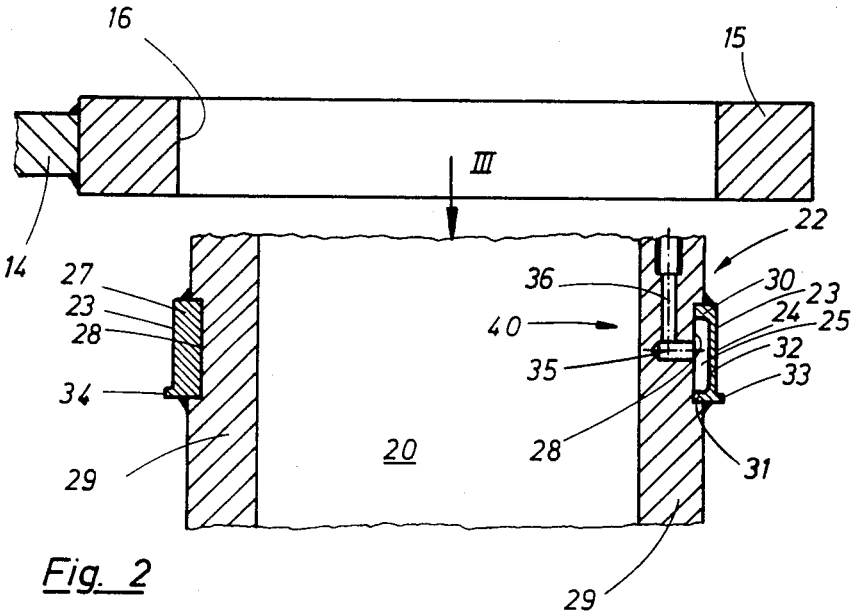
Fig. 2
Fig. 3
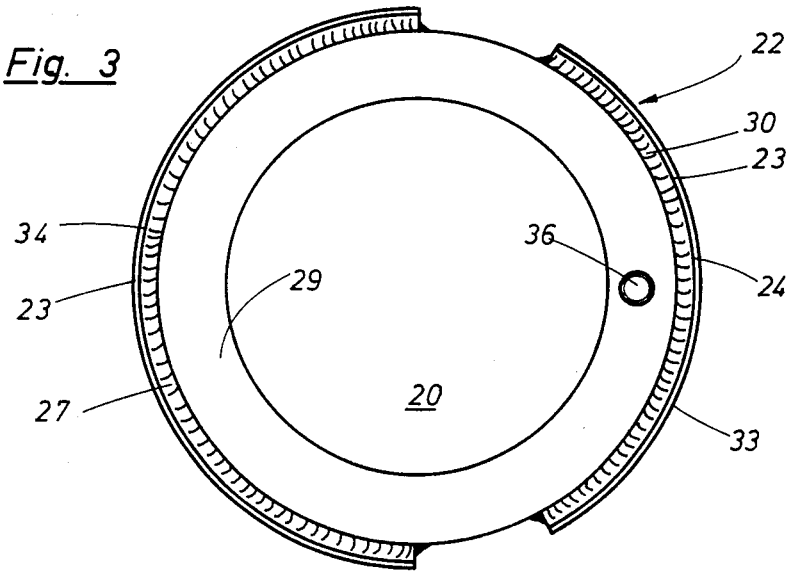

MOLDING DEVICE FOR SHAPING CONCRETE PARTS

BACKGROUND OF THE INVENTION

The present invention relates in general to a mold for shaping concrete parts such as for example concrete pipes, shaft wall rings and the like. The molding device is of the type which includes a hollow mold core, at least one centering ring located in the interior of the mold core and being fixedly attached thereto, a core jarring machine, centering means including an annular centering member mounted on the periphery of the core jarring machine and having a cylindrical outer surface fitting a cylindrical inner surface of the centering ring such that the latter together with the mold core can be inserted on the centering member, hydraulic clamping means arranged between the core jarring machine and the centering means to exert radial pressure against a movable clamping member and displace the same into engagement with the inner surface of the centering ring.

In a prior art molding device of this kind the centering ring mounted on the core jarring machine consists of individual holders arranged in circumferential direction of the machine in a spaced relation one to another and each having an outer surface. Each holder supports a pressure member which is arranged for a reciprocating movement in a radial passage in the housing of the core jarring machine and is urged by a resetting spring into the radial passage. The rear side of the pressure piece is provided with pistons reciprocating in corresponding cylinders in the form of cylindrical bores in the holder. The cylinders are supplied via pressure conduits with a hydraulic fluid acting on the free end faces of the pistons. Upon pressurizing of the fluid the pistons are displaced into the assigned cylinders whereby the pressure piece is shifted in radial direction against the force of the resetting springs. Such a hydraulic clamping device for clamping and releasing the mold core on a centering jarring machine can be provided on several locations on the centering jarring machine where unbalances might occur. This hydraulic core clamping device makes it possible to rapidly replace a mold core on the jarring machine for another one.

The disadvantage of such known clamping devices is the considerable installation space required for its component parts. Another substantial disadvantage of the prior art clamping device is its high manufacturing costs which render the whole molding device more expensive. In addition, the component parts of the known clamping device are relatively complicated. The installation of numerous movable parts necessitates many seals which apart for increased manufacturing and installation costs require additional maintenanace costs. The seals are subject to wear and therefore leakage in the course of service life must be taken into account. The resetting springs for biasing the pressure piece into its starting position is another element requiring further manufacturing costs and is prone to breakage leading to an inoperativeness of the clamping device. Also the sliding elements performing a relative movement to the adjoining parts are also exposed to wear causing non-uniform distribution of clamping forces which in turn may result in the blocking of the whole clamping device.

SUMMARY OF THE INVENTION

It is therefore a primary object of this invention to eliminate the disadvantage of prior art molding devices.

In particular, it is an object of this invention to provide such an improved molding device in which the hydraulic clamping means are simpler in construction and substantially less expensive in manufacture.

Another object of this invention is to provide such an improved clamping means for the molding device which is assembled of substantially smaller numbers of component parts and movable elements and which operates practically without any wear.

Still another object of this invention is to provide such an improved clamping means which eliminate the problems with sealings.

In keeping with these objects and others which will become apparent hereafter, one feature of this invention resides in a molding device of the above described kind, in the provision of centering means which includes a pressure chamber formed between the core jarring machine and the centering member on the machine, the pressure chamber communicating with a source of pressure medium, at least one radially flexible ring segment forming a part of the centering member and communicating with the pressure chamber, the ring segment being pressed into engagement with the inner surface of the centering ring of the mold core when the pressure in the chamber is increased.

Due to the fact that the pressing member is a component part either of the centering ring secured to the mold core or in a kinematic reversal of the centering member mounted on the core jarring machine and delimiting a pressure chamber controlled by the hydraulic fluid, there are practically no detached movable parts. Also no sealing problems are present inasmuch as the ring segment in the centering member or in the centering ring does not require any sealing rings or collars. It is of particular advantage when the clamping ring segment which forms a part of centering means of the molding device is rigidly connected to the adjoining annular parts of the centering member. In this case any relative displacement between the interfaces is eliminated. This embodiment reduces the manufacturing expenditures and due to the absence of any sliding surfaces no wear will occur. An additional advantage of this embodiment is the requirement for an extremely small installation space for the ring segment and its pressure chamber. Still another advantage is the possibility to create very large effective clamping surfaces between the mold core and the core jarring machine and consequently very large clamping forces can be generated. By adjusting the size of clamping surfaces and/or of the pressure of the hydraulic fluid, the clamping forces can be readily changed to a desired magnitude. Furthermore, this invention provides condition for eliminating external conduits such as hoses, pipes and the like for suppyling the hydraulic fluid because the arrangement according to this invention permits the creation of such conduits in the form of internal channels leading directly in the wall of the housing of the core jarring machine or in the reversed embodiment in the centering ring on the mold core.

In another preferred embodiment of this invention, a ring segment in the form of a toroidal hose or in the form of a toroidal hose segment can be arranged in a corresponding recess in the centering member or centering ring. In this embodiment, the pressure chamber is located within the toroidal hose. Also in this example, any relative displacement between sliding surfaces is eliminated and no sealing problems can occur. This embodiment is easy to manufacture because the clamping toroidal hose is simply inserted in a corresponding groove in the housing of the core jarring machine or in a groove in the centering ring on the mold core.

In still another advantageous embodiment the pressure chamber is formed immediately between a surface of a housing of the core jarring machine and a wall portion of the inner ring or alternatively within a wall portion of the outer ring. The ring segment can be also made in the form of an annular member extending along the entire periphery of the outer centering ring attached to the core jarring machine and delimiting an annular pressure chamber. Preferably, this annular ring segment is anchored between the housing of the core jarring machine and the attached inner ring by way of bulging edges similarly as in a car tire.

In a particularly advantageous embodiment the ring segment which as mentioned before, may extend over the entire circumferential angle or over a portion of the circumference, is made of an elastic material which resets automatically into its rest position so that additional resetting elements, such as resetting springs, can be dispensed with. The clamping action is achieved by the expansion of the ring segment when pressure of the hydraulic fluid is increased and when the pressure is relieved, the ring segment due to its elastic quality returns into its initial condition. This embodiment has proved as particularly simple and inexpensive. The ring segment, can be made of the same metal material as the corresponding clamping ring and the adjacent pressure chamber can be formed as a corresponding groove in the housing of the core jarring machine or in the centering ring.

The matching cylindrical surfaces of the inner centering ring and of the outer centering ring are machined with a tolerance between 0.2 millimeters and 0.1 millimeters. By providing this tolerance range, it is ensured that the mold core is insertable onto the core jarring machine without problems and even if a metallic ring segment is used, its radius is increased within this tolerance range and guarantees a reliable clamping of the mold core to the jarring machine. Since the tolerance range between the cylindrical interfaces of the centering ring is relatively small, it suffices to increase pressure of hydraulic medium only within the elasticity limits of the metallic ring segment forming an integral part of the centering ring. Accordingly, no plastic deformation will occur. In this manner it is guaranteed that upon pressure relief the ring segment elastically and automatically resumes its initial shape and the play or tolerance between the cylindrical surfaces of the centering rings is reestablished. Consequently, the mold core can be rapidly and problem-free removed from the core jarring machine and another mold core can be inserted on the latter.

In another preferred embodiment of this invention, the inner centering ring forms an integral part of the housing of the core jarring machine and is formed integrally with the pressure chamber and with the corresponding ring segment acting as the clamping pressure member. This embodiment is also very simple and inexpensive to in manufacture. The attachment of the centering ring to the machine housing is preferably made by welding. In still another advantageous embodiment, the pressure chamber and the corresponding supply conduits leading to a source of hydraulic medium are formed directly in the housing of the core jarring machine so that when pressure in the chamber is increased the outer wall portion delimiting the pressure chamber is elastically deformed and exerts in radial direction the clamping pressure against the cylindrical inner surface of the outer centering ring of the mold core. This embodiment has the advantage that separate conduits for supplying hydraulic or pressure fluid can be eliminated and at the same time the manufacturing cost is reduced.

It will be understood that the clamping action can be kinematically reversed in such a manner that the pressure chamber and the adjacent clamping ring segments can be made also on the outer ring which is attached to the mold core. Nevertheless, in practice it has been proved more advantageous to provide the pressure chamber with corresponding fluid supply conduits and the elastically expandable ring segment on the centering part associated with the core jarring machine. As mentioned before, the ring segment which can extend over the entire peripheral angle of the centering rings or a part thereof, can be in general used for clamping a hub to a shaft apart from the above described application for the removable attachment of a mold core to a centering housing of a core jarring machine. The latter application is of particular advantage due to the fact that it enables not only an extremely fast mold core exchange but also to clamp the mold core to the jarring machine at several axially spaced locations on the housing where unbalances may occur. The clamping is affected by a single switching step because the hydraulic pressure fluid simultaneously actuates all pressure chambers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a sectional side view of a cutaway part II in FIG. 1, shown on an enlarged scale;

FIG. 3 is a top view in the direction of arrow III in FIG. 2, of the centering core jarring machine.

DESCRIPTION OF THE PREFERRED EMBODIMENTS

Figure 1:
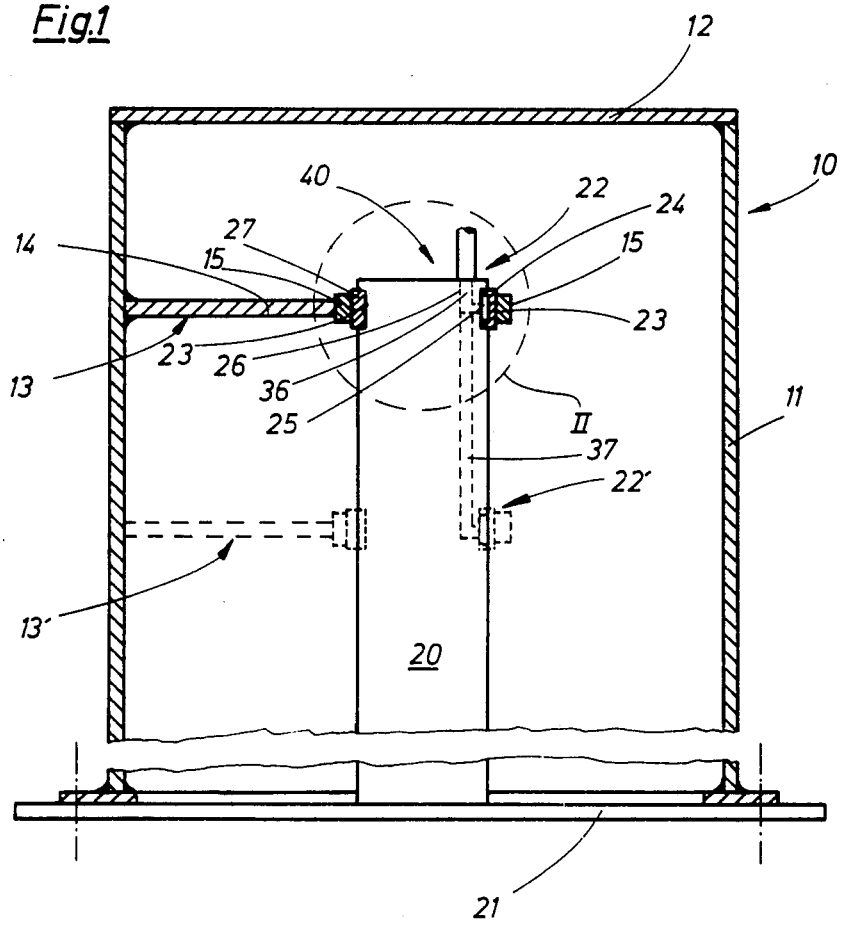
FIG. 1 is a side view, partly in section of a mold core of a molding device for shaping concrete parts in accordance with this invention.

FIG. 1 illustrates schematically a mold core 10 of a molding device used for shaping concrete articles, particularly shaft wall rings, shaft collars, well rings, transition rings, concrete pipes and the like. Further components of the molding device of this kind which are unrelated to this invention, have been omitted fo the sake of clarity. Such additional components and the overall method of operation of a molding device of this kind is described for example in German Pat. No. 3,110,185.

The mold core 10 has the form of a hollow cylinder. It includes a cylindrical jacket 11 closed at its top end with a cover 12. The mold core 10 is provided in its interior with centering means and is insertable on fitting centering means of a core jarring machine 20. The centering machine 20 is supported on a base plate 21.

An inner wall of the hollow mold core 10 is provided with at least one radially directed centering socket 13. As indicated by dashed lines, a corresponding further socket 13' is arranged at an axially spaced relation below the first mentioned socket 13.

The socket 13 is constituted by a plate 14 whose outer edge is attached by welding to the inner wall of the jacket 11. The size of the plate 14 corresponds for example to three-quarters of the circular area of the cover 12. The inner edge of plate 14 supports a centering ring 15 whose outer periphery is secured to the plate 14 by welding and whose inner cylindrical surface 16 serves for centering and supporting the mold core 10 on an inner centering ring 24, 27 mounted on the core jarring machine 20, as it will be explained below.

In a modification of the socket 13, the supporting plate 14 is replaced by spoke-like radial arms attached at one end thereof to the inner wall of the jacekt 11 and supporting at other ends the centering ring 15.

The core jarring machine 20 in this embodiment has a cylindrical housing 29 which supports on its periphery a centering inner ring 24, 27 whose outer cylindrical surface 23 matches the inner cylindrical surface 16 (FIG. 2) of the surrounding ring 15. In the assembled condition shown in FIG. 1, the rings 15 and 24, 27 form a centering assembly 22 which coaxially supports the mold core 10 on the core jarring machine 20. A corresponding centering assembly 22' indicated by dashed lines, is provided in the range of the other socket 13'.

The fitting cylindrical surfaces 16 and 23 of the rings 15 and 24, 27 makes it possible to insert exchangeably the mold core on the jarring machine and hold the same thereon in a fixed working position coaxially with the center axis of the jarring machine 20.

A clamping device 40 is provided in the centering means 22 between the inner centering ring 24, 27 and the outer centering ring 15 in such a manner as to press an elastically resettable pressure member against the cylindrical surface 16 of the outer centering ring 15.

According to one feature of this invention, the pressure member consists of a cylindrical wall segment 32 which in this embodiment is an integral part of the inner centering ring and which delimits a pressure chamber 25 formed between the housing of the machine 20 and part 24 of the inner centering ring. The pressure chamber 25 is connected via a supply conduit 26 to a source of pressure medium, preferably pressure oil, which is controlled to increase or release pressure in the chamber 25.

The wall segment 32 acting as a pressing member of the clamping device 40 extends in this embodiment over a center angle between 120° and 140° of the periphery of the housing 29 of the machine 20. As it will be explained below, the wall segment 32 may also extend over the entire circumferential angle of the inner centering ring. The cylindrical outer surface 23 of the inner ring part 24 is normally flush with the outer surface 23 of the remaining part 27 of the inner centering ring.

Both the clamping ring part 24 and the remaining part 27 of the inner ring are inserted into a peripheral groove 28 of the housing 29 of the machine 20. The bottom of the peripheral groove 28 in the range of the clamping ring part 24 represents an opposite wall of the pressure chamber 25 connected via a supply conduit to the source of hydraulic liquid. In this embodiment, the ring part 24 is of metal forming an integral part of the inner ring. By the action of the pressure medium in pressure chamber 25, the wall segment 32 is elastically deformed in radial direction and upon relieving the pressure of hydraulic medium it automatically returns to its normal position. In cross section, the part 24 of the inner ring delimiting the pressure chamber has a substantially U-shaped cross section resembling in operation a tire. Lateral walls 30 and 31 of the pressure chamber snugly fit into the peripheral groove 28 in the machine housing 29 and are attached to the housing by welding for example. The recess in the part 24 of the inner ring as mentioned before delimits with the bottom wall portion of the groove 28 the pressure chamber 25. In the range of the pressure chamber the lateral walls 30 and 31 are hermetically sealed and fixedly attached to the housing 29 by welding. The cylindrical wall segment 32 of the ring part 24 is reduced in thickness with respect to the remaining part 27 of the ring ring and consequently is elastically deformable by the action of pressure fluid counteracting the rigid bottom wall in the peripheral groove 28.

The inner contact surface 16 of the outer centering ring 15 and the outer cylindrical surface 23 of the inner ring 24, 27 are machined to have a predetermined minute play relative to each other. The play or tolerance range amounts between a maximum about 0.2 millimeters and a minimum of about 0.1 millimeter. This tolerance range or play is sufficient to guarantee a problem-free insertion and centering of the mold core 10 on the core jarring machine 20. At the same time, the play is sufficiently small that in increasing pressure in the pressure chamber 25 the wall 32 of the ring segment 24 is deformed in its elastic range only and not in its plastic range.

The inner centering ring 24, 27 is formed on its lower edge with radial projections 33 and 34 extending respectively in the range of the full thickness of the ring part 27 and of the reduced wall thickness of the ring part 24. The projections 33 and 34 act as supporting abutments for the centering ring 15 of the mold core 10.

Supply conduit 26 for hydraulic medium is formed in the wall of housing 29. In the embodiment of FIG. 1, the supply conduits are made as channels or bores 35 and 36. A corresponding supply conduit 37 indicated by dashed lines, leads to the additional pressure chamber formed in the additional centering means 22'.

In the illustrated example each centering means 22 or 22' includes an inner centering ring which is secured as a separate element to the housing 29 of the jarring machine. In a modification the inner center ring 24, 27 is made as an integral part of the housing 29. The corresponding pressure chambers are made as blind bores extending in axial direction a small distance from the upper surface of the housing 29 in such a manner as to elastically expand the adjacent housing wall portion when pressure of the hydraulic medium is increased.

In another modification, the operation of clamping means 40 of this invention remains the same when in contrast to the embodiment of FIG. 1 the outer centering ring 15 is provided with a pressure chamber adjoining a ring segment cooperating with the outer cylindrical surface 23 of the inner centering ring.

When it is desired to release the mold core 10 from its clamped position on the centering core jarring machine 20, then the pressure of hydraulic medium in pressure chambers 25 is released. As a consequence, due to the elasticity of the wall segment 32 the latter automatically returns into its normal position without the need of additional resetting elements such as for example resetting springs and other component parts which hitherto were necessary in prior art solutions. Due to this elastic resetting the centering ring 15 of the mold core 10 is released and the mold core 10 can be lifted and removed from the supporting core jarring machine 20. It is evident that in the case of several axially spaced centering devices 22, 22' the elastic clamping and releasing of the corresponding ring segments occurs simultaneously by a single pressure relieving operation.

If desired, a new mold core 10 can be replaced on the centering core jarring machine 20 by inserting its centering rings 15 of sockets 13 and 13' on the corresponding inner rings 23, as indicated in FIG. 2. The before described play between the engaging surfaces 16 and 23 make this centering exchange problem-free. The projecting abutments 33, 34 on the lower edge of the inner ring 24, 27 prevent the downward slippage of the outer centering ring 15. Then the hydraulic pressure medium, preferably a hydraulic oil, is admitted through channels 35 through 37 into the chambers 25 to exert a corresponding pressure against the clamping wall segment 32. The resulting elastic deformation of the thin wall segment 32 of the ring part 24 eliminates the play between the engaging surfaces and the outer cylindrical surface 23 of the inner ring 24, 27 is pressed against the inner surface 16 of the outer ring 15. Since the engaging surfaces are relatively large, a correspondingly large clamping force is generated even if considering energy needed for the elastic expansion of the wall 32 of the ring part 24. By adjusting pressure of the hydraulic medium or by changing the size of clamping surfaces it is possible to generate such clamping forces which guarantee a continuous and rigid clamping of the mold core 10 with the core jarring machine 20 also during vibrations of the latter.

The hydraulic clamping device according to this invention has the following advantages:

It is simple and extraordinarily economic. It requires an extremely small installation space. A matching to different magnitude of forces generated during jarring is without problems and by a suitable design of cooperating clamping surfaces and/or by the selection of pressure in pressure chamber 25 such an adjustment is readily made possible. A further substantial advantage of the clamping means of this invention is the fact that the hydraulically operated elastic ring segment eliminates the need for any separate movable parts and does not require any complicated sealing elements which are subject to wear. At the same time, it is guaranteed that no leakage of hydraulic pressure fluid can occur. The manufacture of the clamping device is very simple and inexpensive. The pressure medium supply conduit 26 in the form of channels 35 through 37 can be machined directly in the housing 29 and consequently in this region no grooves conduit parts are necessary. By virtue of the elastic deformation of the wall 32 of the inner ring part 24 there is no need for additional resetting elements (springs and the like) so that manufacturing cost and maintenance are further reduced.

In a nonillustrated embodiment of the inner centering ring 22 attached to the housing of jarring machine the ring part 24 with the corresponding pressure chamber extends over the entire circumference of the ring.

In still another nonillustrated embodiment the inner centering ring 23 on the jarring machine is provided on its circumference with a groove into which a toroidal hose-like pressure chamber is inserted whereby the outer wall of the chamber acts as an annular clamping segment. It will be understood that also in the case of these modifications the clamping ring segment with the corresponding pressure chamber can be arranged in the opposite centering ring 15. The described hydraulic clamping device in principle can be also used for other applications, for example for clamping a hub to a shaft. However, in connection with the centering means for supporting a mold core 10 on a centering jarring machine 20, the novel clamping means provide the substantial advantage of extremely fast replacement of mold cores whereby the mold core is simultaneously clamped at several axially spaced locations (inicated by dashed lines in FIG. 1) by a single switching impulse. This multiple clamping is advantageous when the jarring machine 20 has several axially spaced unbalances, for example in the area of the axially spaced clamping devices.

Figure 4:
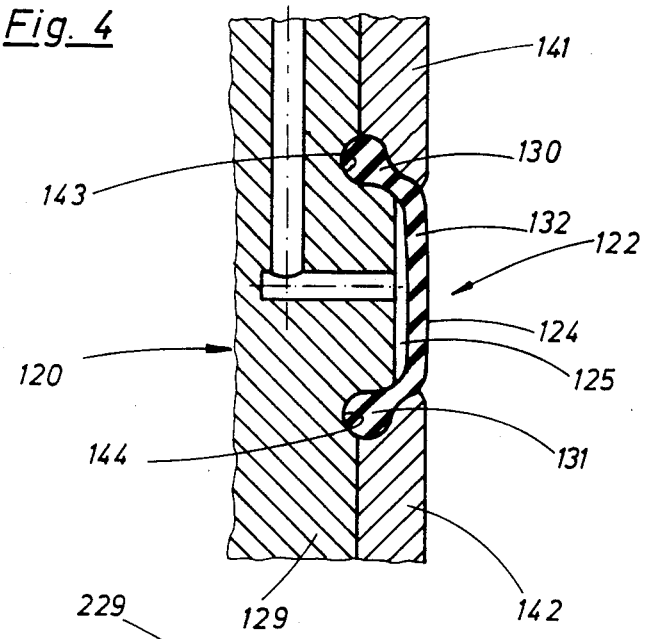
FIGS. 4 and 5 show further modifications of clamping means for the centering parts of the device of this invention.

In another embodiment of this invention illustratted in FIG. 4, like component parts are denoted by the same reference numerals preceded by 1. The clamping ring segment 124 in this example is made of an annular flexible wall 132 made of a rubber-like elastic material whose upper and lower edges are expanded into bulges which are clamped into corresponding annular recesses 143, 144 in the outer surface of the machine housing 129. The bulges 130, 131 are pressed in position on housing 129 by rings 141, 142. The resulting ring segment 124 thus represents a clamping diaphragm which can be made of rubber, an elastic plastic material and the like which is wear resistant.

Figure 5:
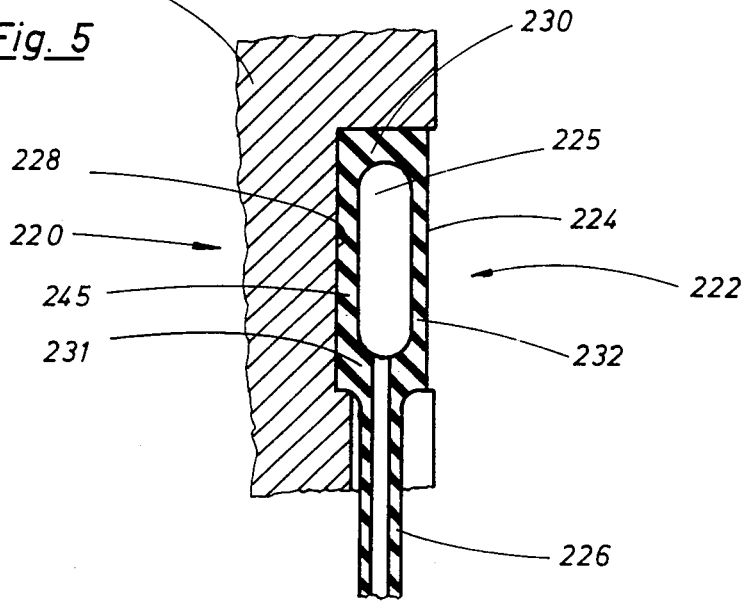

In still another embodiment illustrated in FIG. 5 the like component parts are indicated by the same reference numerals preceded by numeral 2. In this example, the ring segment 224 is in the form of a toroidal hose whose interior represents the pressure chamber 225 delimited on all sides by walls 230, 231, 234 and 245. The pressure chamber 225 communicates with a source of pressure medium via a conduit 226 of the same material. The hose-like annular segment 224 is arranged in a circumferential groove 228 of the housing 229 of a jarring machine 220. The advantage of this embodiment is the fact that no separate parts for mounting the ring segment to the machine housing are required because the pressure chamber of the ring segment is completely leak proof. It can be made also of rubber, of plastics or similar elastically deformable material as the annular wall 132 in FIG. 4.

While the invention has been illustrated and described as embodied in a specific example of a molding device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A molding device for shaping concrete parts such as pipes or shaft wall rings, comprising a mold core; a core jarring machine including a cylindrical housing; centering means including at least one centering outer ring attached to the inner wall of said mold core, and at least one centering inner ring attached to said housing of the core jarring machine, said outer and inner rings having cylindrical metal surfaces fitting each other with a predetermined play to allow insertion of said mold core on said core jarring machine; hydraulic clamping means arranged in said inner ring to exert in radial direction a clamping pressure against said cylindrical surfaces, said clamping means including at least one elastic wall segment forming part of the cylindrical surface of said inner ring, at least one pressure chamber formed between said housing and said wall segment of the inner ring; means for conecting said pressure chamber with a source of pressure medium to expand said elastic wall segment against an opposite cylindrical surface when pressure is increased, and said elastic wall segment returning automatically to a contracted position when pressure is relieved; said housing of the core jarring machine being formed with a circumferential groove and said centering inner ring being made of at least two separate parts arranged in spaced circumferential said groove relation in and secured to said housing by welding, at least one of said separate ring parts being of a substantially U-shaped cross-section including said elastic wall segment, and delimiting said pressure chamber; said connecting means including an axially directed channel formed in the wall of said housing and communicating with said pressure chamber; and said inner ring having a lower edge provided with radial projections for supporting said outer ring.

2. A molding device as defined in claim 1, wherein said predetermined play is in the range between 0.2 millimeters and 0.1 millimeter.

3. A molding device as defined in claim 1, wherein said inner ring is an integral part of said housing of the jarring machine.

4. A molding device as defined in claim 1, wherein at least one other of said separate ring parts is a circumferential segment which is not open to said source of pressure medium.

* * * * *